United States Patent [19]

Blue

[11] 4,088,532

[45] May 9, 1978

[54] TARGETS FOR PRODUCING HIGH PURITY $^{123}I$

[75] Inventor: James W. Blue, Bay Village, Ohio

[73] Assignee: The United States of America as represented by the Administrator of the National Aeronautics and Space Administration, Washington, D.C.

[21] Appl. No.: 394,207

[22] Filed: Sep. 4, 1973

Related U.S. Application Data

[63] Continuation-in-part of Ser. No. 266,927, Jun. 28, 1972, abandoned, which is a continuation-in-part of Ser. No. 863,280, Oct. 2, 1969, Pat. No. 3,694,313.

[51] Int. Cl.$^2$ ..... G21G 1/10

[52] U.S. Cl. ..... 176/11; 176/16; 250/400; 250/429; 250/492 B

[58] Field of Search ..... 176/11, 16; 250/429, 250/400, 492, 432, 1-26

[56] References Cited

U.S. PATENT DOCUMENTS 3,694,313 9/1972 Blue et al. ..... 176/11

OTHER PUBLICATIONS

Uses of Cyclotrons in Chemistry, Metallurgy and Biology, Proc. Conf., Sep. 1969, edited by Amphlett, pp. 127, 128, 138-148, 160-163, 168-172, 261, 264.

*Primary Examiner*—Harvey E. Behrend

*Attorney, Agent, or Firm*—Norman T. Musial; John R. Manning; Gene E. Shook

[57] ABSTRACT

Tellurium powder in improved targets is bombarded with a cyclotron beam to produce $^{123}Xe$. Flowing gas streams carry the $^{123}Xe$ through one cold trap which removes contaminants to another cold trap which removes $^{123}Xe$ that subsequently decays to $^{123}I$.

During this bombardment energy is deposited in the target material causing its temperature to rise. Some of the tellurium vaporizes and subsequently condenses on surfaces that are cooler than the vaporization temperature. Provision is made for the repeated bombardment of this condensed tellurium.

2 Claims, 2 Drawing Figures

TARGETS FOR PRODUCING HIGH PURITY $^{123}I$

ORIGIN OF THE INVENTION

The invention described herein was made by an employee of the United States Government and may be manufactured and used by or for the Government for governmental purposes without the payment of any royalties thereon or therefor.

RELATED APPLICATION

This application is a continuation-in-part of abandoned application Ser. No. 266,927 filed June 28, 1972 which, in turn, is a continuation-in-part of application Ser. No. 863,280 filed Oct. 2, 1969 and now U.S. Pat. No. 3,694,313.

BACKGROUND OF THE INVENTION

This invention is concerned with the production of high purity radioiodine for thyroid measurement and as a general radionuclide. The invention is particularly directed to an improved target for bombarding $^{122}Te$ or $^{123}Te$ with a beam that is within the energy limitations of a cyclotron to produce $^{123}I$.

Radioactive iodine is used for medical diagnostic studies. The isotope $^{131}I$ has been used for this purpose because of its availability. The radioisotope $^{123}I$ is considered much superior to the $^{131}I$ in studies where the amount of radiation exposure to a patient is of prime concern. The radiation exposure received by a patient from $^{123}I$ is about 1/40th that of an equal amount of $^{131}I$ because of the shorter half-life and the decay by electron capture.

The gamma ray energy of $^{123}I$ is 159 KEV compared to 364 KEV for $^{131}I$. Collimators associated with gamma ray scanning devices operate more effectively with this lower energy. Also the collimators used with $^{123}I$ are less bulky.

A method of $^{123}I$ production is disclosed in copending application Ser. No. 863,280 which is now U.S. Pat. No. 3,694,313. This method uses a target assembly which includes a porous plate for supporting enriched tellurium powder target material in a compact cyclotron having a $He^3$ beam at an energy up to 30 MEV. Conventional cyclotrons have $He^3$ beams at energies up to about 76 MEV.

When bombarded with beams of 30 to 50 microamperes of alpha particles or $He^3$ tellurium radiation damages. This target material gets so hot that it vaporizes and redeposits in cooler regions. This reduces the efficiency of $^{123}I$ production.

SUMMARY OF THE INVENTION

This problem has been solved by utilizing targets constructed in accordance with the present invention. In one embodiment the target assembly is oscillated normal to the cyclotron beam so that the tellurium that has vaporized, moved out of the beam, and condensed on cooler target material powders is moved back into the beam for further bombardment.

Another embodiment utilizes ridges or fins in the cyclotron beam to hold the tellurium powder. Because these fins are below the vaporization temperature, vaporized tellurium condenses on them and is again bombarded.

OBJECTS OF THE INVENTION

It is, therefore, an object of the present invention to provide an improved target for producing the radioisotope $^{123}I$ having sufficient purity for use as a radiopharmaceutical by bombarding particles of tellurium with beams of 30 to 50 microamperes of alpha particles or $He^3$.

Another object of the invention is to provide an improved apparatus for making high purity $^{123}I$ using a cyclotron without the dissolution of the target together with a chemical separation of $^{123}I$ and the subsequent chemical recovery of the target.

A further object of the invention is to provide an improved reusable generator for the production of $^{123}I$ wherein $^{123}Xe$ is physically separated from a tellurium target that is bombarded by a beam from a cyclotron.

These and other objects of the invention will be apparent from the specification which follows and from the drawings wherein like numerals are used throughout to identify like parts.

DESCRIPTION OF THE PREFERRED EMBODIMENT

Figure 1:
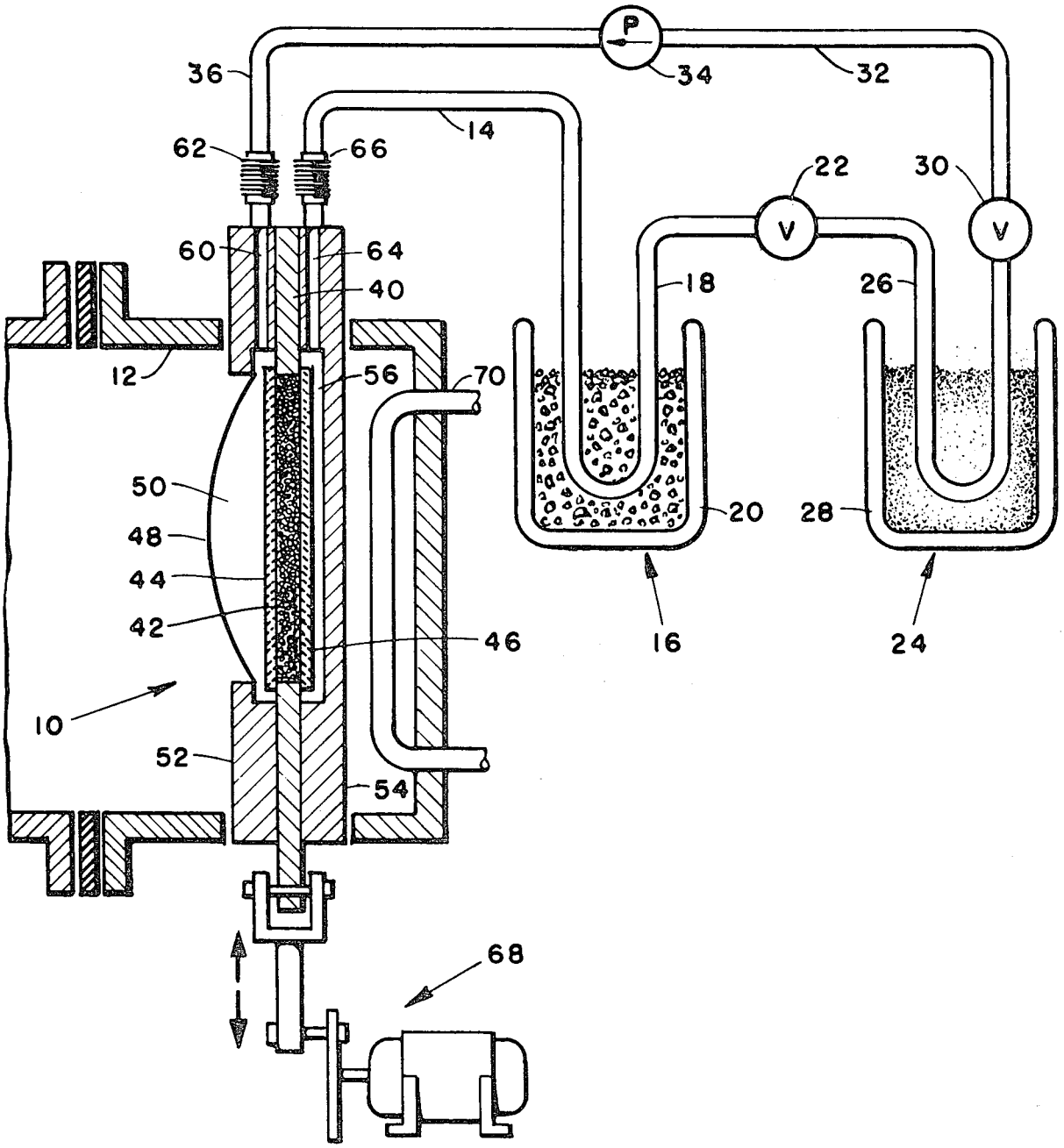
FIG. 1 is a schematic view of a generator constructed in accordance with the invention for producing radioactive iodine.

Referring now to FIG. 1 a target assembly 10 constructed in accordance with the present invention is mounted in a beam duct 12 of a small accelerator, such as a 60-inch cyclotron. A beam of helium particles of energy equal to about 40 MEV or less is emitted from the cyclotron and passes through the beam duct 12 to bombard the target 10. It is contemplated that other cyclotrons may be used.

A tube 14 connects the target 10 to a cold trap 16. Tygon tubing has been satisfactory for the tube 14. The cold trap 16 comprises a U-tube 18 immersed in a coolant in an insulated container 20. A ½-inch copper U-tube surrounded by solid carbon dioxide in a Dewar has been satisfactory. The dry ice maintains the trap 16 at a temperature of −79° C.

A valve 22 connects the dry ice trap 16 to a second cold trap 24. A ¼-inch copper U-tube 26 immersed in liquid nitrogen in a Dewar 28 has been satisfactory. The liquid nitrogen maintains the trap 24 at a temperature of −196° C.

A valve 30 connects the liquid nitrogen trap 24 to a tube 32 which enters a self-contained gas pump 34. The target 10 is placed in communication with the pump 34 through a tube 36.

According to the present invention the target assembly 10 utilizes a housing 40 having an aperture therein for receiving a target material 42. Spaced sheets 44 and 46 of porous carbon are mounted on opposite sides of the housing 40 to form a chamber for containing the powder target material 42. The porous carbon is not subject to radiation damage. Also, the porous carbon will not pass one micron size particles or larger particles.

A thin metal foil window 48 is spaced from the porous carbon sheet 44 to form a plenum 50. Two mil aluminum foil is satisfactory for this window. The foil 48 is mounted in an aluminum window frame 52 that is secured to the housing 40. A back plate 54 is spaced from the porous carbon sheet 46 to form a space 56.

A passage 60 in the frame 52 places the plenum 50 in communication with the tube 36 through an expansion bellows 62. Similarly a passage 64 in the back plate 54 places the space 56 in communication with the tube 14 through an expansion bellows 66.

A motor driven bell crank mechanism 68 is connected to the housing 40 to oscillate the target assembly 10 within the duct 12. The bellows 62 and 66 enable the oscillation target assembly 10 to be connected to stationary tubes 36 and 14 respectively. It is contemplated that an air cylinder may be used to oscillate the target assembly 10.

The cross sectional area of the cyclotron beam in the duct 12 is such that only about half the target material 42 is bombarded at any given moment. The cyclotron beam deposits energy in the tellurium powder causing the temperature to rise to a point where some of the tellurium vaporizes. This temperature of vaporization is actually considerably less than the boiling point because of a radiation damage phenomenon.

The vaporized tellurium moves to cooler portions of the chamber between the spaced sheets 44 and 46 out of the cyclotron beam where it condenses on the powder target material that is cooler than the vaporization temperature of the tellurium. The target is moved back and forth normal to the cyclotron beam to reposition this condensed target material along with a portion of the powder target material back in the beam for further bombardment.

By oscillating the target assembly 10 the remaining tellurium is removed from the beam for a period of time sufficient for it to cool before being cycled back into the beam. This reduces the average temperature of the target material.

In operation, target material of 95.4% enriched tellurium powder is bombarded by the beam from the cyclotron in the duct 12. This bombardment of the tellurium produces xenon in accordance with the reactions $^{122}$Te ($\alpha$ 3n); $^{122}$Te (He$^3$, 2n); or $^{122}$Te (He$^3$, 3n).

A flow of helium gas is passed through the tellurium powder 42 to carry away the $^{123}$Xe into the dry ice trap 16 and then into a liquid nitrogen trap 24. By utilizing a closed loop system as shown in FIG. 1 a gas flow rate may be used that both transports the xenon and cools the powder target material while conserving the helium gas.

The temperature of the target assembly 10 may be controlled by circulating water in a cooling system 70. This cools the back plate 54.

Figure 2:
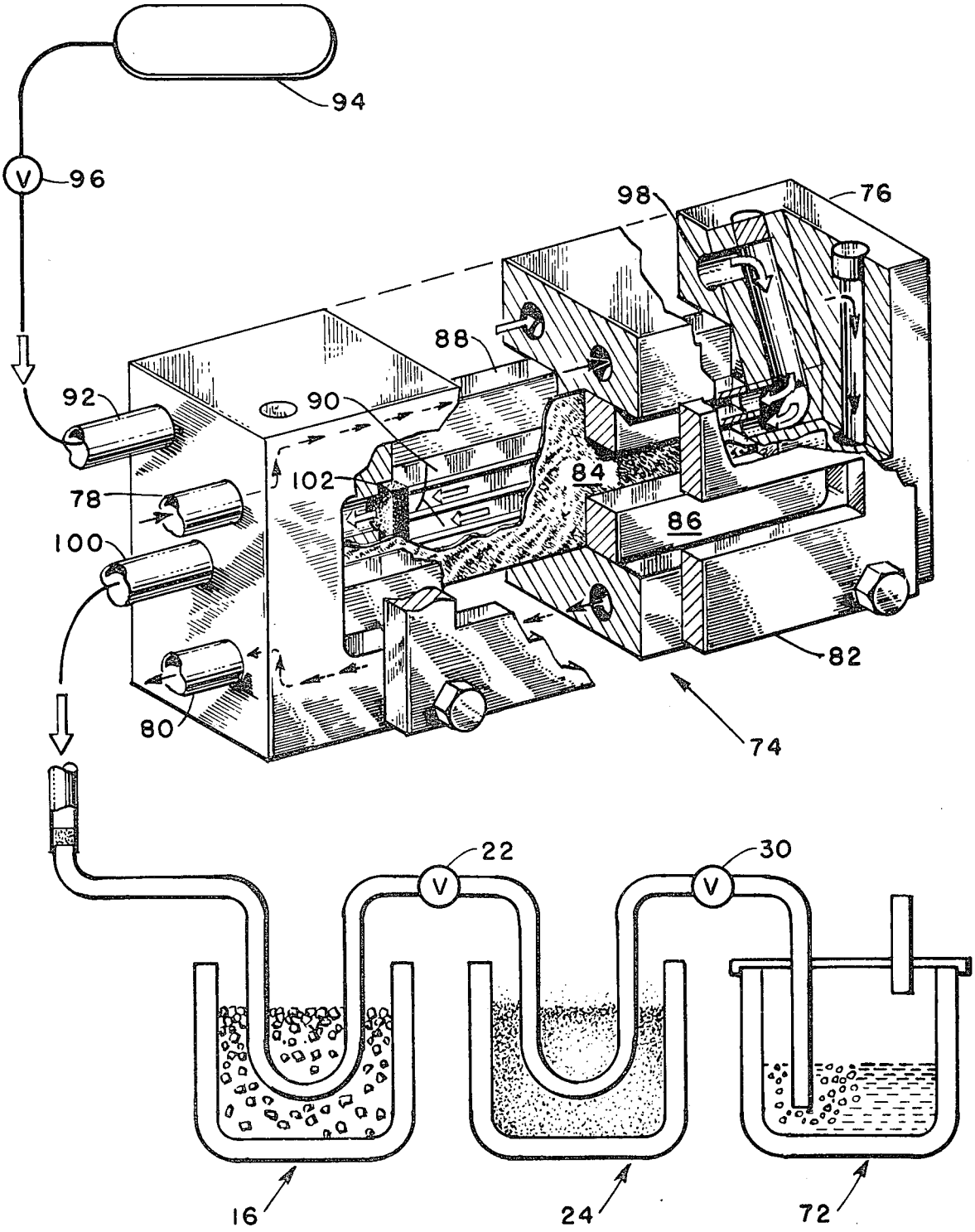
FIG. 2 is a perspective view of an alternate embodiment of a target constructed in accordance with the invention used in a modified $^{123}I$ generator.

The conservation of the helium gas is not an important consideration when very low flow rates are used. In such cases a single pass system of the type shown in FIG. 2 is used. In this embodiment the target assembly is placed in communication with cold traps 16 and 24 through a tube in a manner previously described in connection with FIG. 1. This embodiment is not a recirculating system and it is vented to the atmosphere through an oil bubbler 72. The single pass system eliminates the pump and no evacuation of the system is required because the single pass system can be flushed.

With the low flow rates of the single pass system no cooling of the target 10 is realized and the gas is only utilized to carry the xenon to the cold traps. While the high flow rates of a closed system may be desirable for cooling, such flow rates may carry impurities through the trap 16 into the trap 24.

In both the closed loop system of FIG. 1 and the single pass system of FIG. 2 helium carries the xenon from the target assembly into the dry ice trap 16. Contaminants with freezing points higher than −78° C are frozen out of the gas stream in the trap. These contaminants cling to the walls of the cold trap 16. Among the contaminants removed in this trap are the undesirable $^{124}$I, $^{125}$I and $^{126}$I.

The helium gas flow then carries the xenon into the liquid nitrogen trap 24 where the xenon and other products with freezing points between −79° C and −196° C are frozen out. After bombardment the liquid nitrogen trap 24 is sealed by closing the valves 22 and 30. The U-tube 26 is removed from the liquid nitrogen in the container and set aside until the $^{123}$I ingrowth is optimized. The 2.1 hour $^{123}$Xe decays to $^{123}$I in about 4 to 8 hours. This time may be used to transport the $^{123}$I from the cyclotron to a laboratory or hospital.

After waiting for the $^{123}$Xe to decay, the U-tube 26 is flushed with helium gas to remove the remaining $^{123}$Xe and the $^{125}$Xe. The trap is rinsed with a dilute NaOH and the solution is counted to ascertain the presence of $^{124}$I. The $^{123}$I is placed in a suitable chemical form for its ultimate medical use. Direct tagging of organic molecules is possible in the trap 24. By way of example, macroaggregated serum albumin has been tagged with $^{123}$I by merely contacting a solution with the trap 24.

The bulk gas temperature at a helium flow rate of 5 standard liters per minute exiting a trap 50 centimeters long and 3 millimeters in diameter is approximately the temperature of the wall of the trap. With such a flow rate the helium would cool the target material 42 and the gas temperature would be lowered enough to freeze the radioxenon. However, at such flow rates the radioiodines do not stick to the wall of the U-tube 17 and the amount of $^{124}$I in the liquid nitrogen trap 24 is excessive. At the 5 liter per minute flow rate the gas is not in the dry ice trap 16 long enough to insure complete radioiodine diffusion to the wall of the U-tube 18. This results in low trap efficiency.

Reducing the flow rate to 0.02 liters per minute increases the efficiency of the dry ice trap 16 to about 100%. However, no cooling of the target material is utilized.

A flow rate of 10 liters per minute has been found to be adequate to cool the target material sufficiently to avoid deterioration in the beam. However, this flow rate forces many contaminants from the dry ice trap 16 into the liquid nitrogen trap 24 and baffling is required in the trap 16.

The generator shown in FIG. 1 has an advantage in that the yield per hour bombardment is nearly independent of bombardment time. Thus in utilizing a small cyclotron for the production of large amounts of $^{123}$I the length of bombardment time would be determined from schedule condsiderations or a minimization of trap changes rather than from optimizing the yield.

DESCRIPTION OF AN ALTERNATE EMBODIMENT

Referring now to FIG. 2 there is shown an alternate embodiment of the invention. In this embodiment a target assembly 74 is mounted in the beam duct of a small cyclotron. The target assembly 74 utilizes a housing 76 having a plurality of cooling passages. A copper block is preferable for the housing 76. The passages are connected to a suitable source of cooling water through tubes 78 and 80.

A collimator 82 at the front of the housing 76 intercepts misdirected alpha particles from the cyclotron. The collimator is mounted in the beam duct 12 shown in FIG. 1.

The alpha particles pass through the collimator 82 to a metal foil window 84. Two mil aluminum foil has been satisfactory for this window. This foil is clamped around the peripheral surface of an aperture in a housing 76 by an aluminum window frame 86 having a centrally disposed elongated slot. A sealing gasket contacts the foil window 84 and the frame 86.

An important feature of this embodiment is the structure of an improved back plate 88. A plurality of fins 90 on the back plate 88 act as shelves to hold the tellurium powder. Fins 90 having a thickness of about 0.015 inch have been satisfactory. The back plate 88 is preferably aluminum and defines a chamber with the aluminum foil 84. The fins 90 extend forward into this chamber to the foil 84. The purpose of the fins 90 is to provide a greatly increased surface area onto which the vaporized tellurium can condense. Because the fins 90 are in the beam the tellurium that recondenses on the fins is still effective target material and can be bombarded to produce $^{123}$Xe. The fins 90 stay cool enough to condense tellurium because they are metallic and hence good conductors of heat.

A tube 92 is connected to a suitable source 94 of helium gas through a valve 96. A low flow of helium gas passes through a passage 98 in the housing 76 and is introduced into the chamber between the back plate 88 and the foil 84. The helium gas flows over the tellurium powder on the fins 90.

Helium gas and xenon are discharged from the housing 76 through a tube 100. A porous metal filter 102 is provided to enable the helium-xenon gas to pass from the target region to the cold trap 16 through the tube 96. The porous metal filter has a pore size of about 1 micron. The flow rate of the gas is low enough that the forces of the gas on the powder is quite small. A flow rate of about 5 mil per minute of helium has been satisfactory. At this rate the tellurium powder is not carried to the filter 102. The porous filter 102 retains the tellurium in the target 74 during handling prior to bombardment.

The gas then flows through the traps 16 and 24 in the manner previously described. The gas is discharged to the atmosphere through the oil bubbler 72.

While several embodiments of the invention have been shown and described it will be appreciated various structural modifications may be made without departing from the spirit of the invention or the scope of the subjoined claims. By way of example, the cyclic method of producing $^{123}$I as shown in FIG. 1 can be used with the target assembly 74 shown in FIG. 2. Likewise the single pass system shown in FIG. 2 can be used with the target assembly 10 shown in FIG. 1.

I claim:

1. A method of producing high purity $^{123}$I with a cyclotron as a source of a He$^3$ beam of energy up to 50 MEV comprising the steps of moving powders of an isotope from a group consisting of $^{122}$Te and $^{123}$Te into and out of said beam, bombarding said powders in said beam with the He$^3$ beam to produce $^{123}$Xe whereby the powders are heated and a portion thereof is vaporized, condensing the vaporized isotope on the powders out of the beam, whereby the condensed isotope and powders are moved back into said He$^3$ beam so that the same are again bombarded to produce $^{123}$Xe, passing helium through said powders to remove $^{123}$Xe and iodine contaminants therefrom, and sequentially freezing out the iodine contaminants and $^{123}$Xe from said helium.

2. A method of producing high purity $^{123}$I as claimed in claim 1 including oscillating a target containing the powders normal to said beam.

* * * * *